US008757384B2

(12) United States Patent
Ooi et al.

(10) Patent No.: US 8,757,384 B2
(45) Date of Patent: Jun. 24, 2014

(54) DEVICES AND METHODS FOR PACKING

(75) Inventors: Wai Kek Ooi, Penang (MY); Hwa Bee Chuah, Penang (MY)

(73) Assignee: Dell Products, LP., Round Rock, TX (US)

( * ) Notice: Subject to any disclaimer, the term of this patent is extended or adjusted under 35 U.S.C. 154(b) by 542 days.

(21) Appl. No.: 12/938,646

(22) Filed: Nov. 3, 2010

(65) Prior Publication Data

US 2012/0103854 A1 May 3, 2012

(51) Int. Cl.
*B65D 81/02* (2006.01)
*B65D 5/50* (2006.01)
*B65D 81/05* (2006.01)

(52) U.S. Cl.
CPC ..... *B65D 5/5069* (2013.01); *B65D 2585/6837* (2013.01); *B65D 5/5088* (2013.01); *B65D 81/05* (2013.01)
USPC ..... 206/586; 206/587; 206/521

(58) Field of Classification Search
USPC ..... 206/521, 583, 587, 523, 586, 588, 591, 206/592; 220/918; 53/474
See application file for complete search history.

(56) References Cited

U.S. PATENT DOCUMENTS

| | | | | |
|---|---|---|---|---|
| D153,209 | S | 3/1949 | Reamer | |
| 3,016,132 | A * | 1/1962 | Chaplin | 206/305 |
| 3,565,243 | A * | 2/1971 | Freeman | 206/523 |
| 3,807,622 | A * | 4/1974 | Belcher et al. | 206/421 |
| 4,709,817 | A | 12/1987 | Keady et al. | |
| 5,398,808 | A | 3/1995 | Chen et al. | |
| 5,782,354 | A | 7/1998 | Genix | |
| 5,806,683 | A * | 9/1998 | Gale | 206/587 |
| 5,816,409 | A | 10/1998 | Baker et al. | |
| 6,010,007 | A * | 1/2000 | Moren et al. | 206/587 |
| 6,092,651 | A | 7/2000 | Miller | |
| 6,257,412 | B1 | 7/2001 | Yamamoto et al. | |
| 6,520,337 | B2 | 2/2003 | Smith | |
| 6,705,469 | B2 * | 3/2004 | Slot | 206/587 |
| 6,843,374 | B1 | 1/2005 | Li et al. | |
| 6,968,954 | B2 * | 11/2005 | Hsieh | 206/587 |
| 2006/0102516 | A1 * | 5/2006 | Ho | 206/592 |

* cited by examiner

*Primary Examiner* — Steven A. Reynolds
(74) *Attorney, Agent, or Firm* — Egan, Peterman, Enders LLP.

(57) ABSTRACT

Devices and methods for packing objects, including information handling systems and other types of electronic devices that may be implemented using a single piece and assembly-free packing device configuration that has one or more foldable and insertable buffer sections that are foldable to increase the overall strength of the packing device against external loads and shocks.

23 Claims, 13 Drawing Sheets

DEVICES AND METHODS FOR PACKING

FIELD OF THE INVENTION

This invention relates generally to packing devices, and more particularly to packing devices having packing buffers.

BACKGROUND OF THE INVENTION

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Packaging devices for use in shipping objects such as information handling systems and other electronic devices may include packaging cushions that are placed within a shipping box for shipping. Common packaging cushion arrangements include cushions formed of foamed plastic, cushions formed from complex assemblies of multiple die-cut corrugated sheets, and cushions formed from molded pulp fiber. Typical electronic devices that may be shipped using packaging cushions include notebook and desktop computers, scanners, DVD players, etc. These types of devices often have a thickness edge dimension value that is less than the dimensional value of the other edges (e.g., length and width edges), such that the packing configuration that yields the minimum packing volume and packing material enclosure area is a configuration that acts to enclose and support the packed device by the thickness and width edges. However, since such a packing configuration also yields the smallest load area, it also experiences the highest pressure (force per packing material surface area) when under a stacking load.

SUMMARY OF THE INVENTION

Disclosed herein are devices and methods for packing objects, including information handling systems and other types of electronic devices. The disclosed devices and methods may be implemented using a single piece and assembly-free packing device configuration that has one or more foldable and insertable buffer sections that are foldable to increase the overall strength of the packing device against external loads and shocks. When folded, the foldable and insertable buffer sections act to protectively cushion a packed object against stacking loads and to absorb external shocks when the object and packing device are operatively engaged and contained within a shipping box. In one exemplary embodiment, the disclosed packing devices and methods may be advantageously implemented using a single piece of recyclable material (e.g., such as molded pulp fiber) having a main packing device section and one or more buffer sections that are foldable for retainable engagement with one or more respective buffer retention cavities that are defined within the main section of the packing device. In this regard, overall packaging costs may be reduced by employing relatively low cost materials, such as molded pulp fiber, to form the packing device. When constructed of such materials, a packing device may be economically and conveniently recycled.

The main section of a packing device may be configured in one embodiment with a shell-shaped cavity defined therein. The capacity or dimensions of the cavity may be divided into plural cavity sections that function to contain a portion's of an object to be packed or multiple objects to be packed, and that optionally act to cooperatively receive one or more extension members of one or more foldable buffer sections. In this regard, a packing device may be provided with a main section having an object cavity defined therein for receiving an object such as the edge of an information handling system, and with at least one foldable buffer section coupled to, and hingeably extending from, at least one peripheral side edge of the main section. Each of the one or more foldable buffer sections may be configured to fold inwardly toward the main section of the packing device and may be provided with one or more optional extension members that are configured to be foldably received into a corresponding buffer retention cavity or cavities defined in the main section of the packing device in a manner that reinforces the structure of the packing device against bending and buckling. In this regard, the material strength of each extension member may stiffen and contribute to the strength of the main section in order to mutually support and strengthen the overall packing device against bending and buckling. When operatively assembled with a packed object, these features act to cushion the packed object against external loads and to absorbs external shocks in a manner that reduces the resulting shock force on the packed object.

Each buffer retention cavity of a packing device main section may have dimensions complementary and configured to frictionally mate with a corresponding shaped extension member of a respective foldable buffer section in a manner that acts to retain the foldable buffer section in a folded and engaged or inserted position within the buffer retention cavity. Such a frictional engagement between the foldable buffer section and buffer retention cavity also may be provided to mutually support the packing device against external loads/forces and to overall strengthen the packing device structure against bending in response to such external loads/forces. In one exemplary embodiment, a system of packing devices may be provided to support each of two opposing ends of an object (i.e., each of which is received within an object cavity of a corresponding packing device). The assembled object and packing devices may be placed within a shipping container in a manner such that the object is freely suspended within the shipping box between the two packing devices and protected against external loads and shocks.

In one respect, disclosed herein is a device for packing an object, including: a main section having an opening side, a body side and multiple peripheral sides, an object cavity being defined in the main section between the peripheral sides that is continuous with the opening side of the main section, the object cavity being configured to receive a portion of the object for packing; a hinge feature defining a hinge line on one of the peripheral sides of the main section; and a buffer section coupled to the peripheral side of the main section by the hinge feature, the buffer section being configured to fold about the hinge line from an extended position to a folded packing position relative to the main section.

In another respect, disclosed herein is a packing device system, including: at least two packing devices. Each of the two packing devices may in turn include: a main section having an opening side, a body side and multiple peripheral sides, an object cavity being defined in the main section between the peripheral sides that is continuous with the opening side of the main section, the object cavity being configured to receive a portion of the object for packing, a hinge feature defining a hinge line on one of the peripheral sides of the main section, and a buffer section coupled to the peripheral side of the main section by the hinge feature, the buffer section being configured to fold about the hinge line from an extended position to a folded packing position relative to the main section. The object cavity of a first one of the two packing devices is configured to receive a first end of the object for packing, and where the object cavity of a second one of the two packing devices is configured to receive a second end of the object for packing, the first and second ends of the object being opposing ends of the object for packing.

In another respect, disclosed herein is a method for packing an object, including: providing at least one packing device, including: a main section having an opening side, a body side and multiple peripheral sides, an object cavity being defined in the main section between the peripheral sides that is continuous with the opening side of the main section, the object cavity being configured to receive a portion of the object for packing, a hinge feature defining a hinge line on one of the peripheral sides of the main section, and a buffer section coupled to the peripheral side of the main section by the hinge feature, the buffer section being configured to fold about the hinge line from an extended position to a folded packing position relative to the main section. The method may also include providing an object for packing and positioning at least a portion of the object for packing within the object cavity of the packing device to form an assembly of the packing device with the object. The method may also include providing a shipping container having an interior configured to receive the assembly of the object and the packing device, folding the buffer section about the hinge line from the extended position to a folded packing position relative to the main section, and then positioning the assembly of the object and the packing device within the interior of the shipping container.

DESCRIPTION OF ILLUSTRATIVE EMBODIMENTS

Figure 1:
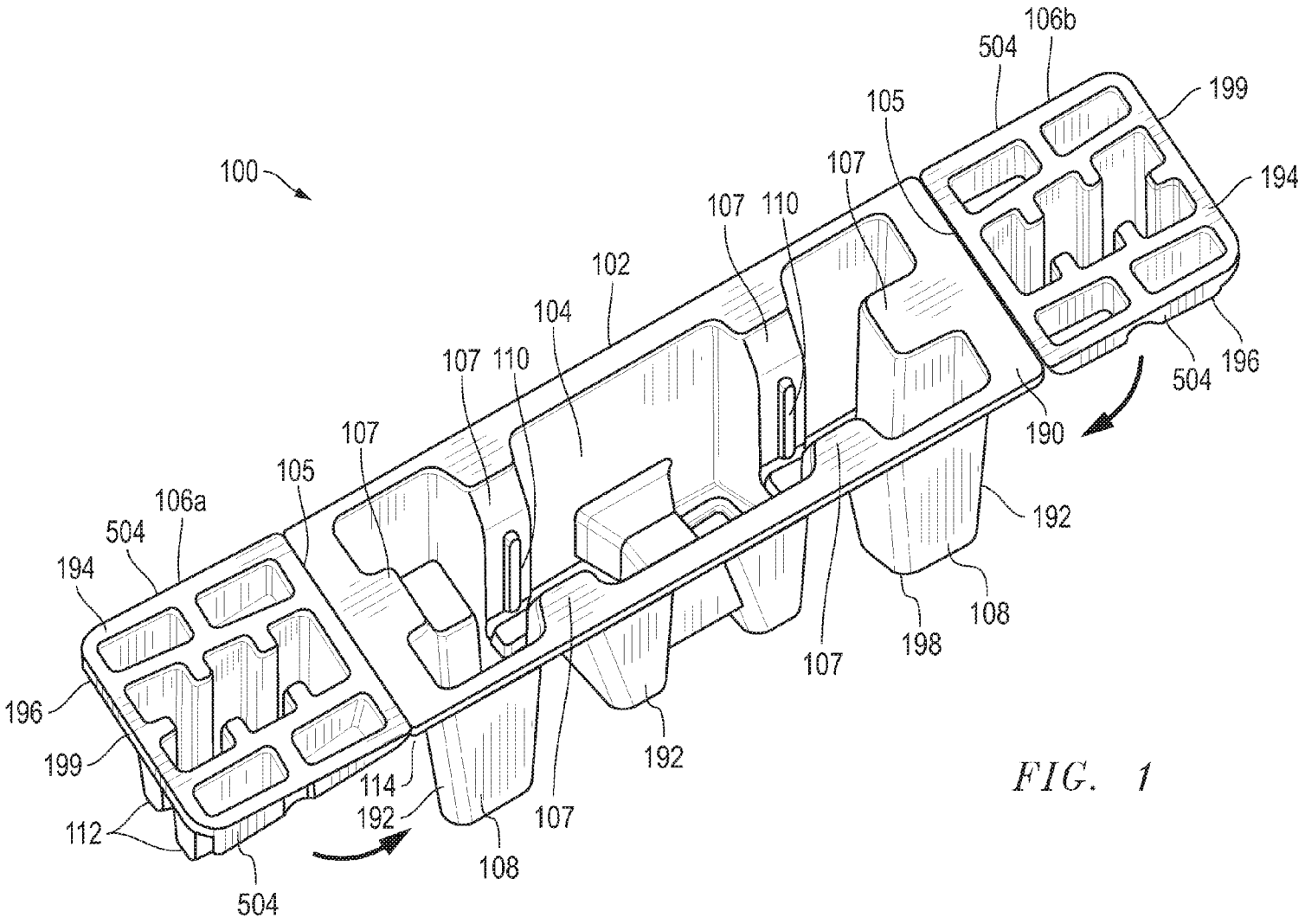
FIG. 1 is a perspective view of a packing device according to one embodiment of the disclosed apparatus and methods.
Figure 2:
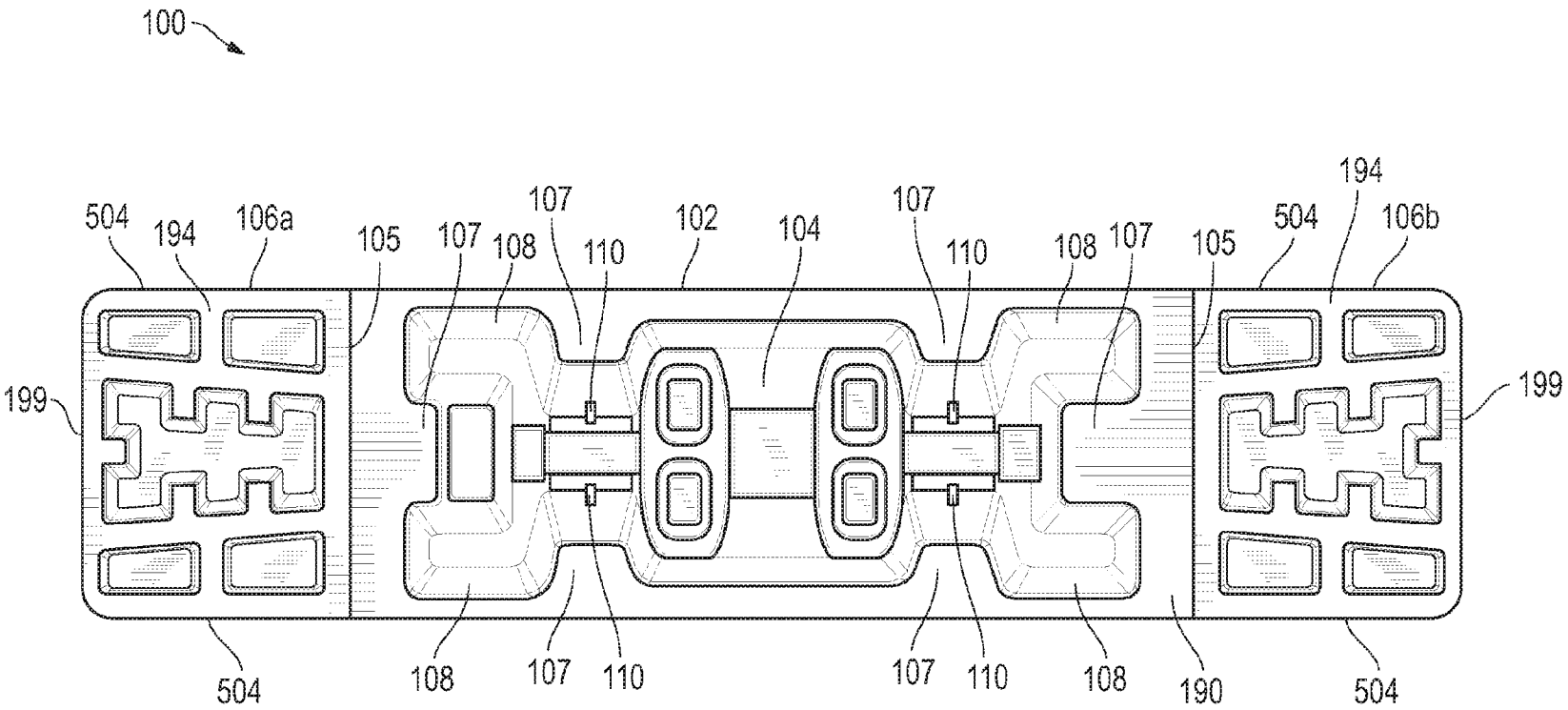
FIG. 2 is an opening side view of a packing device according to one embodiment of the disclosed apparatus and methods.

FIGS. 1 and 2 illustrate a packing device 100 configured for use in packing objects, such as information handling systems and other types of electronic devices. As shown, packing device 100 includes a main packing device section 102 and two foldable buffer sections 106*a* and 106*b* that are each hingeably attached by a hinge feature at a respective hinge line 105 to each of two respective opposing peripheral sides 192 of main section 102. In this exemplary embodiment, each hinge line 105 is formed at the intersection of a peripheral side 192 and opening side 190 of main section 102. Foldable buffer sections 106*a* and 106*b* are shown in outward extended position in FIGS. 1 and 2.

In this exemplary embodiment, opening side 190 of main section 102 has a peripheral portion that is co-planar to a corresponding peripheral portion of the first side 194 of each respective buffer section 106*a* and 106*b*, although this is not necessary. It will also be understood that although FIGS. 1 and 2 show each of foldable buffer sections 106*a* and 106*b* hingeably attached by a hinge line 105 at an intersection of a peripheral side 192 with the opening side 190 of main section 102, it is also possible that the foldable buffer sections 106*a* and 106*b* may alternatively be attached by a hinge line positioned at another location relative to a given peripheral side 192 of main section 102, e.g., at an intersection of a peripheral side 192 with body side 198 of main section 102. Furthermore, although main body 102 is rectangular shaped with four peripheral sides 192 in the exemplary embodiment of FIGS. 1 and 2, it is possible that a main body may have other shapes that include greater than or less than four peripheral sides (e.g., three peripheral sides, five peripheral sides, etc.).

Figure 5:
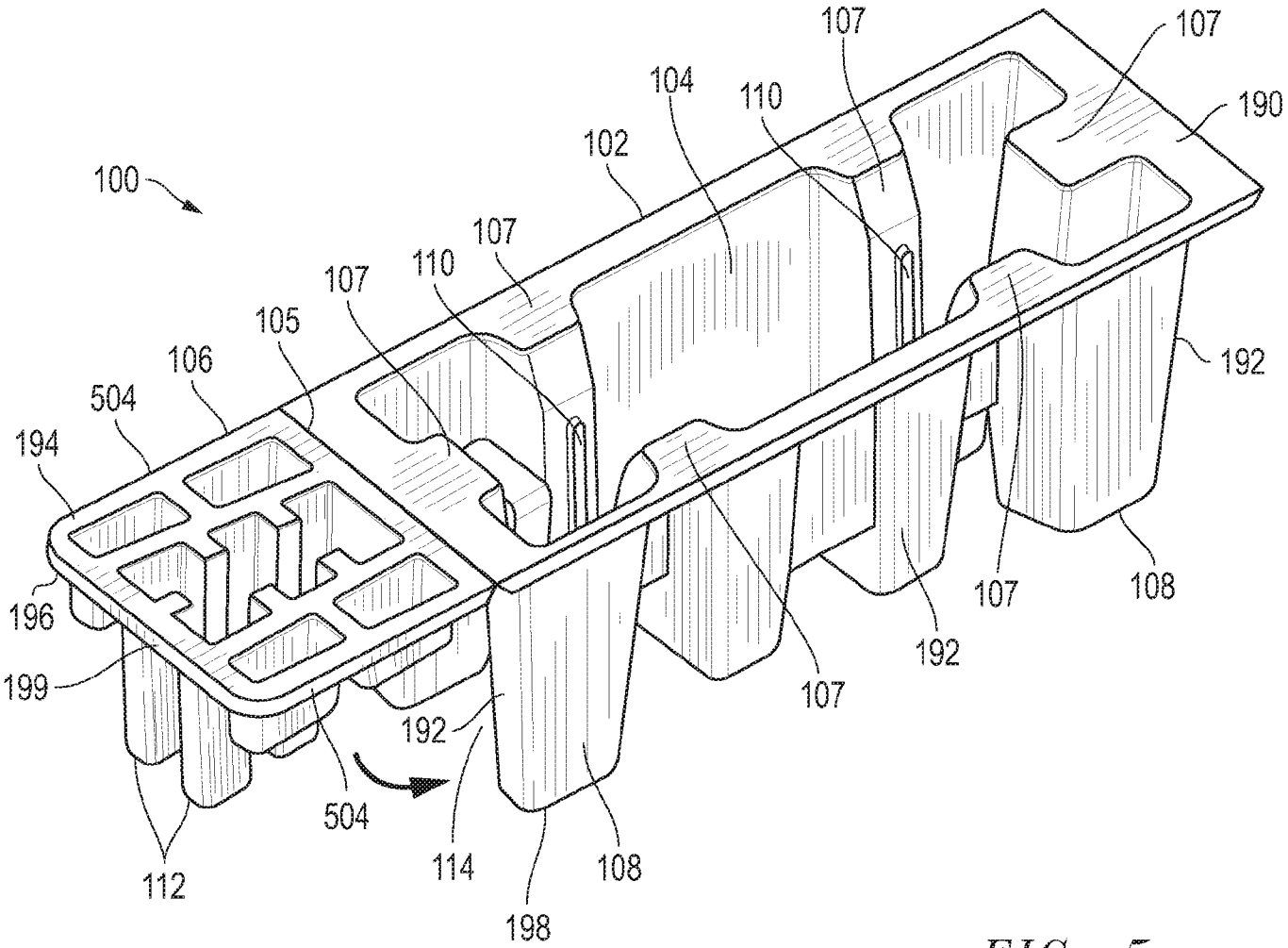
FIG. 5 is a perspective view of a packing device according to one embodiment of the disclosed apparatus and methods.

Main packing device section 102 includes an object cavity 104 therein that is contiguous with the opening side 190 of main section 102 and that is configured and dimensioned for receiving a packed object, such as an information handling system. In this embodiment, object cavity 104 is divided into multiple (e.g., in this case three) sub-cavity sections separated by cavity ribs 107 which are dimensioned to contact the external surfaces of an object to be inserted therein (as shown in FIG. 5). Optional raised gripping surfaces (or "grippers") 110 may be provided on one or more of cavity ribs 107 to contact and frictionally engage the external surfaces of an object inserted into object cavity 104. Each gripping surface may be a raised surface of the same material as main body 102, or may include optional frictional materials such as rubber. Although an object cavity 104 segregated into multiple sub-cavity sections is illustrated in FIG. 1, it will be understood that a single-space (non-segregated) cavity section is also possible. In other embodiments, a packing device 100 may be provided with multiple separate object cavities 104, e.g., to receive corresponding multiple different objects.

In one exemplary embodiment, packing device 100 may be a single piece structure, e.g., in which all components and shapes of the packing device are integrally molded together out of a single piece of corrugated cardboard or moldable material (e.g., fibers such as wood pulp fiber, bamboo pulp fiber, banana pulp fiber; plastics, etc). However, packing device 100 may alternatively provided in other embodiments as multiple pieces that are joined together, e.g., with adhesive such as epoxy, or with fasteners such as plastic rivets or screws. When packing device 100 is a single piece structure, a hinge feature of each hinge line 105 may be integrally defined as part of a corresponding packing device 100, e.g., as a thinned area of material molded to have a reduced (thinned) cross sectional area that is bendable along the hinge line 105 relative to the main body 102 of packing device 100. In those embodiments where packing device 100 is manufactured of plastic, a hinge feature of each hinge line 105 may be, for example, a living hinge. Alternatively, a hinge feature may be a separate non-integral component, e.g., such as a separate hinge component attached between main section 102 and a respective buffer section 106 by adhesive, fasteners, etc. In one exemplary embodiment, a packing device 100 may formed by a single piece of molded pulp fiber having integral hinge features. One example of such a single-piece molded pulp fiber material with integral hinges is formed from recycled corrugated carton box material and is available from Earth Recycle Industries, Seberang Perai, Penang, Malaysia, it being understood that any other suitable material/s may be employed.

In the exemplary embodiment of FIGS. 1-2, a distal (i.e., outside) end 199 of each of foldable buffer sections 106*a* and 106*b* is configured to be folded in the direction of the arrows toward the peripheral side 192 of main section 102. In this regard, a second side 196 of each of foldable buffer sections 106*a* and 106*b* is disposed opposite from the first side 194 of the respective foldable buffer section 106*a* or 106*b* and includes buffer extension members 112 that extend from the second side 196 of each foldable buffer section 106. Buffer extension members 112 are configured and dimensioned to be folded and received or inserted into corresponding buffer retention cavities 114 defined between mating main section extension members 108 on the peripheral side 192 of the main section 102 when the buffer sections 106 are folded toward the peripheral side 192 of main section 102 in the direction of the arrows shown, in a manner to be further described and illustrated in FIGS. 7 and 9 herein.

Although multiple buffer extension members 112 are provided for each foldable buffer section 106 in the embodiment of FIGS. 1-2, it will be understood that only one buffer extension member 112 may be provided for a given foldable buffer section 106. Moreover, the particular geometry and configuration of each foldable buffer section 106 (e.g., number of buffer extension members 112, sidewall thickness of buffer extension members 112, etc.) may be varied, for example, to provide desired or needed strength and/or rigidity for a given application or object to be packed. In this regard, needed strength and rigidity may be determined, for example, based on results of drop tests or any other suitable methodology for measuring external forces that may be applied to a packed object. The number of buns and cavities provided for a given packing device 100 may therefore be adjusted to meet and exceed anticipated pressure (force/area) to which a packed object may be subjected during shipping.

Figure 3:
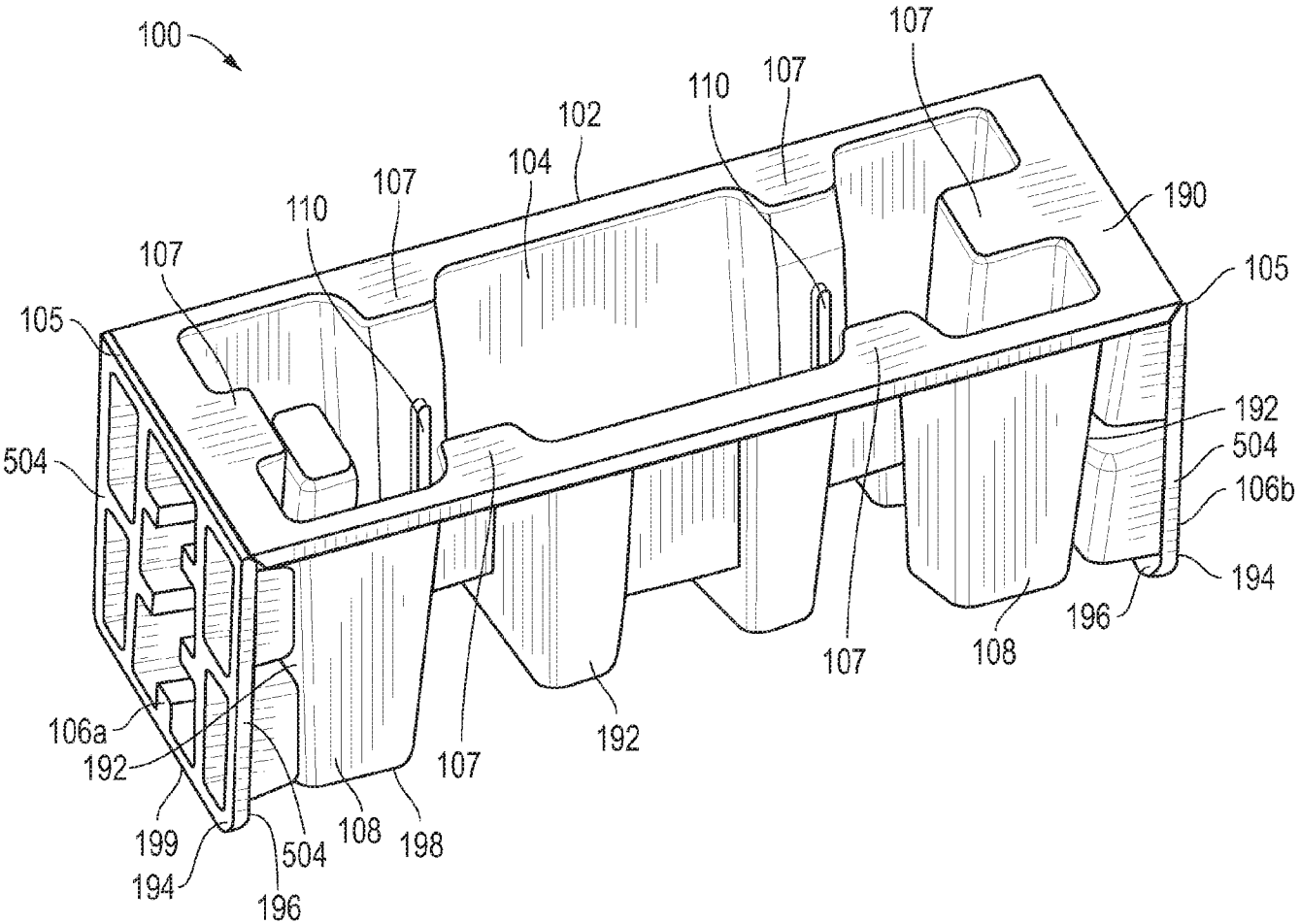
FIG. 3 is a perspective view of a packing device according to one embodiment of the disclosed apparatus and methods.

Still referring to FIGS. 1 and 2, each buffer retention cavity 114 of main section 102 may have dimensions complementary and configured to frictionally mate with the shape of one or more corresponding extension members 108 of a respective foldable buffer section 106 in a manner that acts to retain the second side 196 of foldable buffer section 106 in a folded and engaged relationship with the exterior surface 192 of main section 102 as illustrated in FIG. 3. This folded engagement between the foldable buffer sections 106 and main section 102 acts to mutually support the packing device 100 against external loads/forces and to overall strengthen the structure of packing device 100 against bending in response to external loads/forces. In the illustrated exemplary embodiment, each foldable buffer section 106 is in folded engagement with main section 102 such that the second side 196 of each buffer section 106 is disposed in face-to-face relationship with a surface of a peripheral side 192 of main section 102, and such that each buffer section 106 is positioned in a folded packing position that is oriented about 90 degrees relative to the unfolded outward extended position of the respective buffer section 106, although other orientation angles (greater or less than 90 degrees relative to the unfolded packing position) are possible in other embodiments.

Figure 4A:
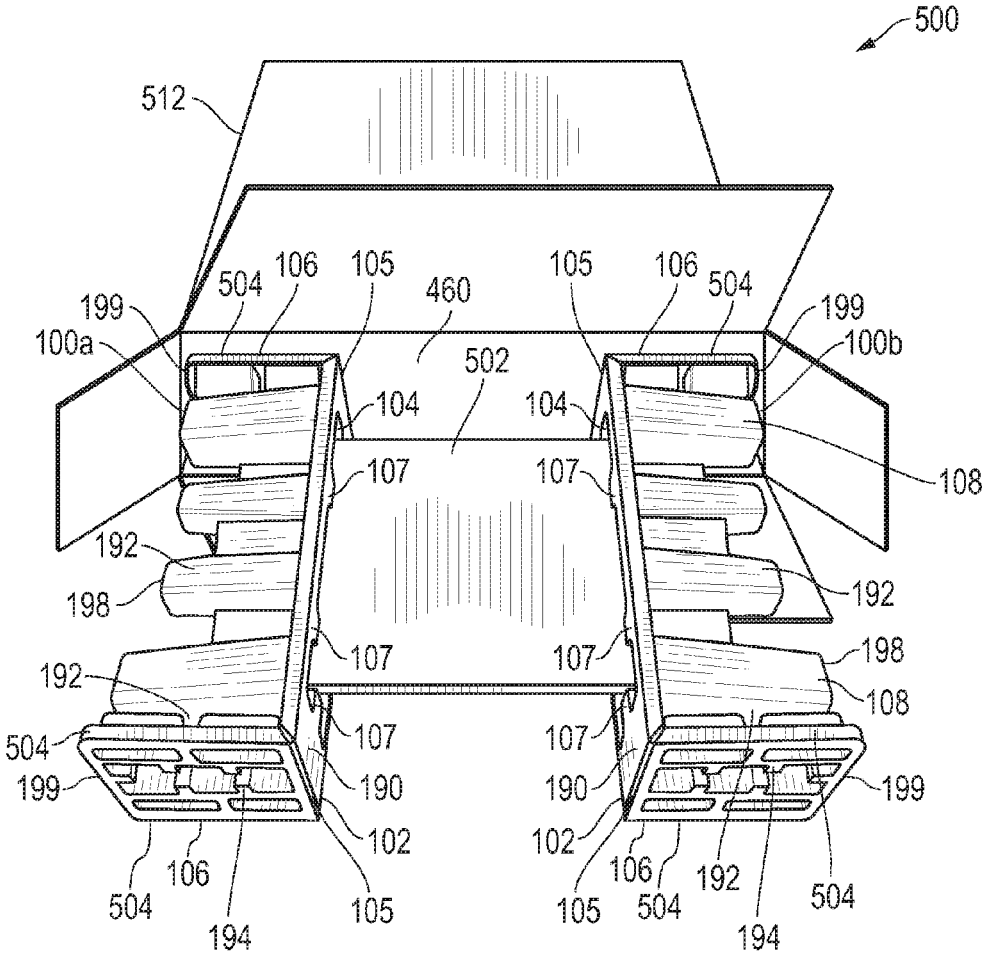
FIG. 4A is a perspective view of a packing device system according to one embodiment of the disclosed apparatus and methods.
Figure 4B:
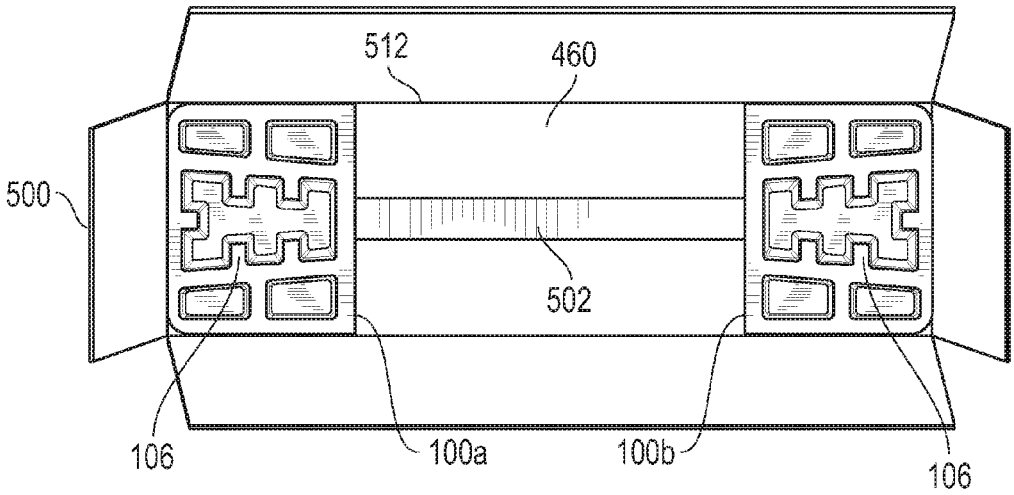
FIG. 4B is a side view of a packing device system according to one embodiment of the disclosed apparatus and methods.

FIGS. 4A-4B illustrate how a packing device system 500 may be provided in one embodiment to support each of two opposing ends of an object 502, such as an information handling system like a notebook computer. In this regard, each of two opposing ends of object 502 may be received within the object cavity 104 of a respective packing device 100*a* or 100*b* such that the opening sides 190 of the packing devices 100*a* and 100*b* face inwardly toward each other. The assembled packing device system 500 with object 502 may be placed within (e.g., slid into the opening 460 of) a suitably dimensioned shipping container 512 (e.g., corrugated cardboard or plastic box) in a manner such that the object 502 is suspended within container 512 between the packing devices 100*a* and 100*b* and such that all sides of the object 502 are displaced at a distance away from the interior walls of box 504, and in this case with sides 199, 504 and 194 of each buffer section 106 contacting the interior surface walls of container 512 in a manner that resists any external stacking loads (e.g., resulting when other packing containers are stacked on top of container 512) and/or compression loads applied to the outside of container 512. It will be understood that in other embodiments, not all of sides 199, 504 and 194 must so contact the interior surface walls of container 512 to provide some resistance to external stacking and/or compression loads applied to container 512 from at least one direction. FIG. 4B is a side view through opening 460 of container 512 showing object 502 suspended within container 512 between the packing devices 100*a* and 100*b* and such that all sides of the object 502 are displaced at a distance away from the interior walls of box 504.

It will be understood that the particular packing device configuration of FIGS. 1-4 is exemplary only, and that the number of foldable buffer sections 106 may be greater or lesser than two and/or may be provided on selected side edge/s of a packing device 100 such that strength and/or rigidity may be added to selected edges or ends of a packing device as needed or desired. For example, FIG. 5 illustrates an embodiment of packing device 100 that has one foldable buffer section 106 that is hingeably attached by a hinge feature at a respective hinge line 105 to peripheral side 192 of main section 102. In other respects, packing device 100 of FIG. 5 is substantially similar in configuration and operation to the packing device embodiment 100 of FIGS. 1-4.

Figure 6:
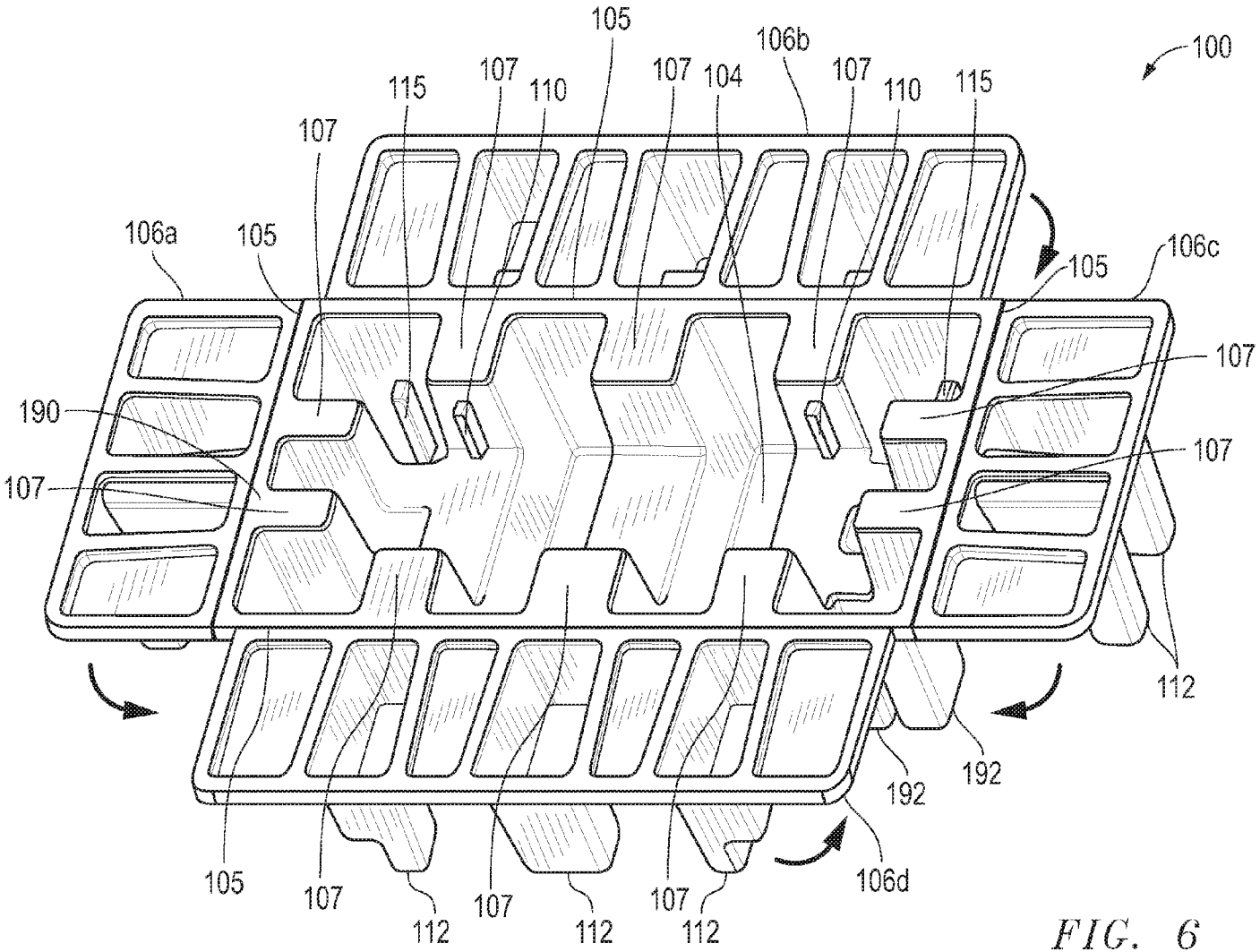
FIG. 6 is a perspective view of a packing device according to one embodiment of the disclosed apparatus and methods.
Figure 7:
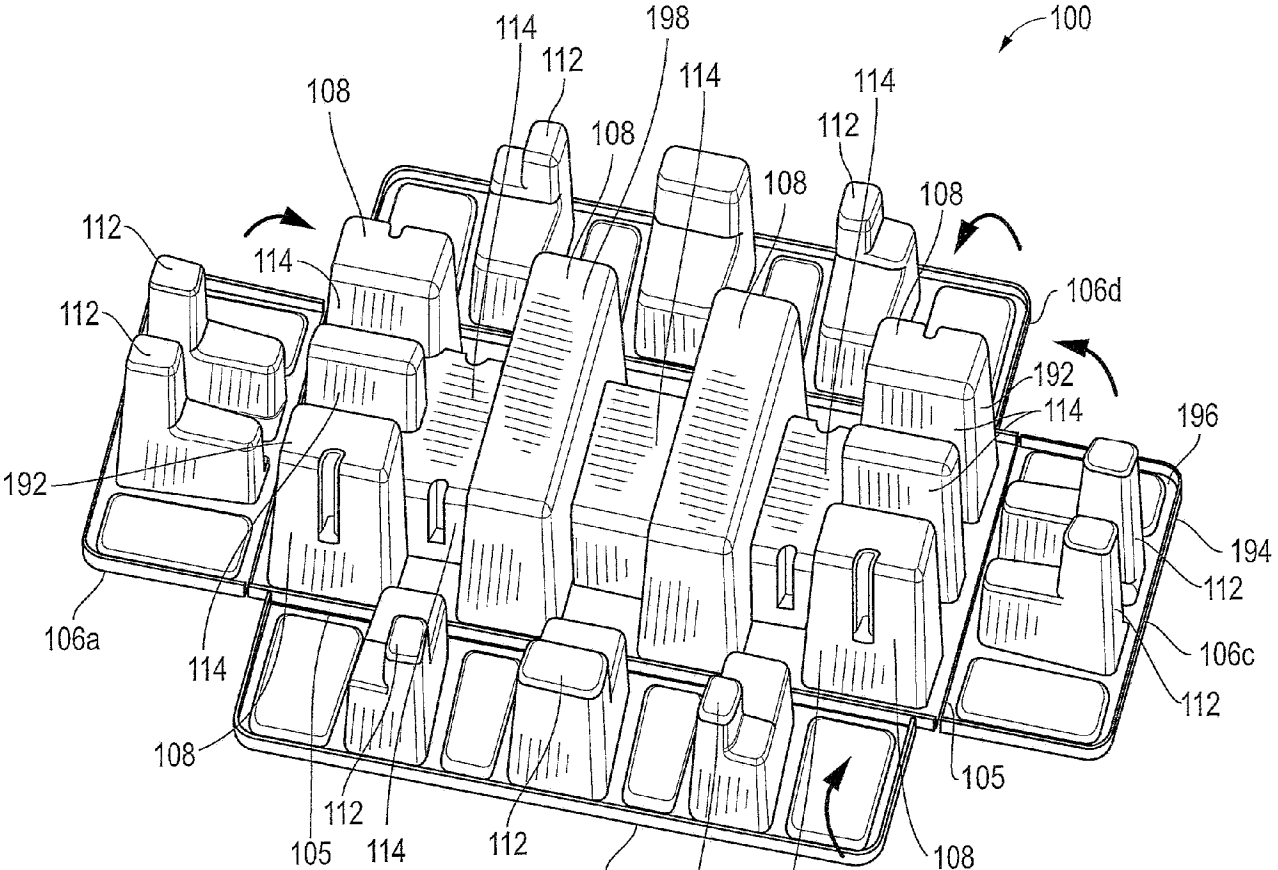
FIG. 7 is a perspective view of a packing device according to one embodiment of the disclosed apparatus and methods.

FIGS. 6-9 illustrate another exemplary embodiment of packing device 100 that includes foldable buffer sections 106*a*, 106*b*, 106*c* and 106*d* that are each hingeably attached by a hinge feature at a respective hinge line 105 to a respective one of four peripheral side edges 192 of main section 102. In other respects, packing device 100 of FIGS. 6-9 is substantially similar in configuration and operation to the packing device embodiment 100 of FIGS. 1-5. In this regard, FIG. 6 illustrates a perspective view taken from the interior side of packing device 100 with its foldable buffer sections 106*a*, 106*b*, 106*c* and 106*d* disposed in unfolded outward extended position. FIG. 7 shows a perspective view from the exterior side of packing device 100 with its foldable buffer sections 106*a*, 106*b*, 106*c* and 106*d* disposed in unfolded outward extended position. In FIG. 7, buffer retention cavities 114 defined between respective mating main section extension members 108 on the peripheral side 192 of the main section 102 may be seen, with one buffer retention cavity 114 defined for each corresponding mating buffer extension member 112 defined on second side 196 of each foldable buffer section 106.

Figure 9:
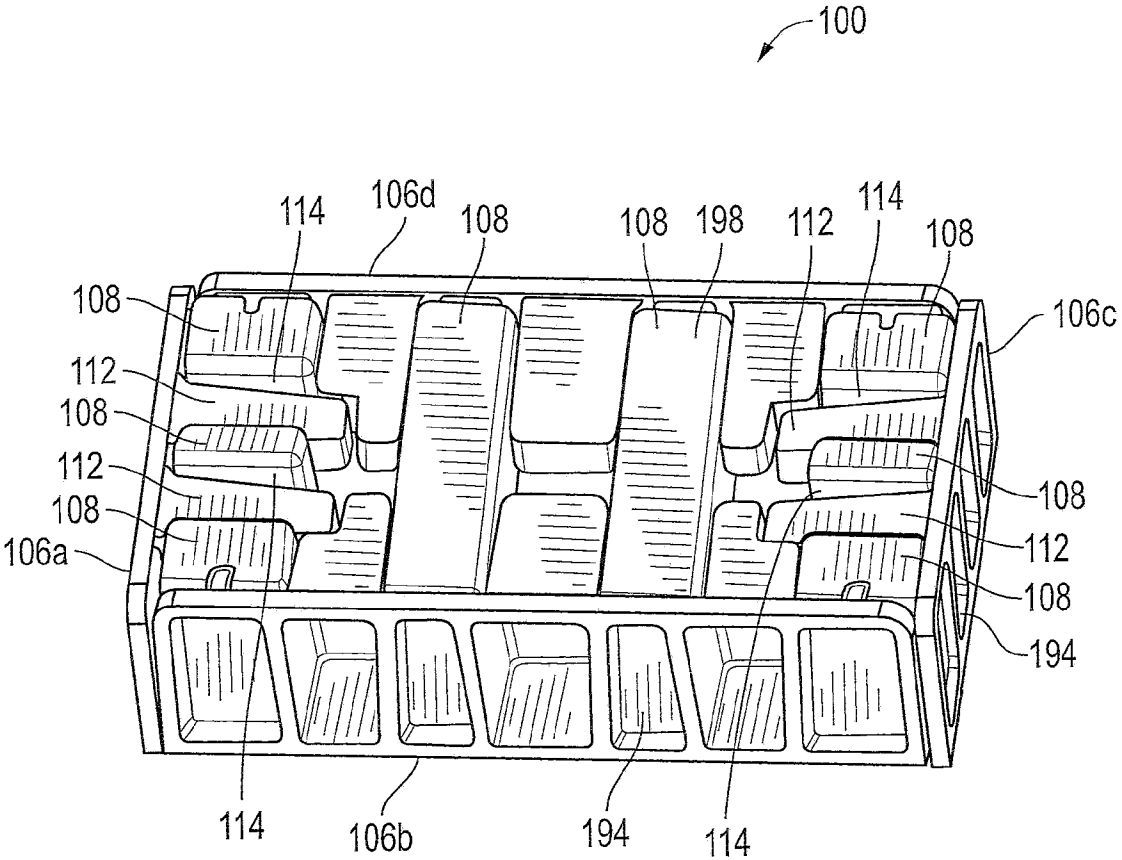
FIG. 9 is a perspective view of a packing device according to one embodiment of the disclosed apparatus and methods.
Figure 10:
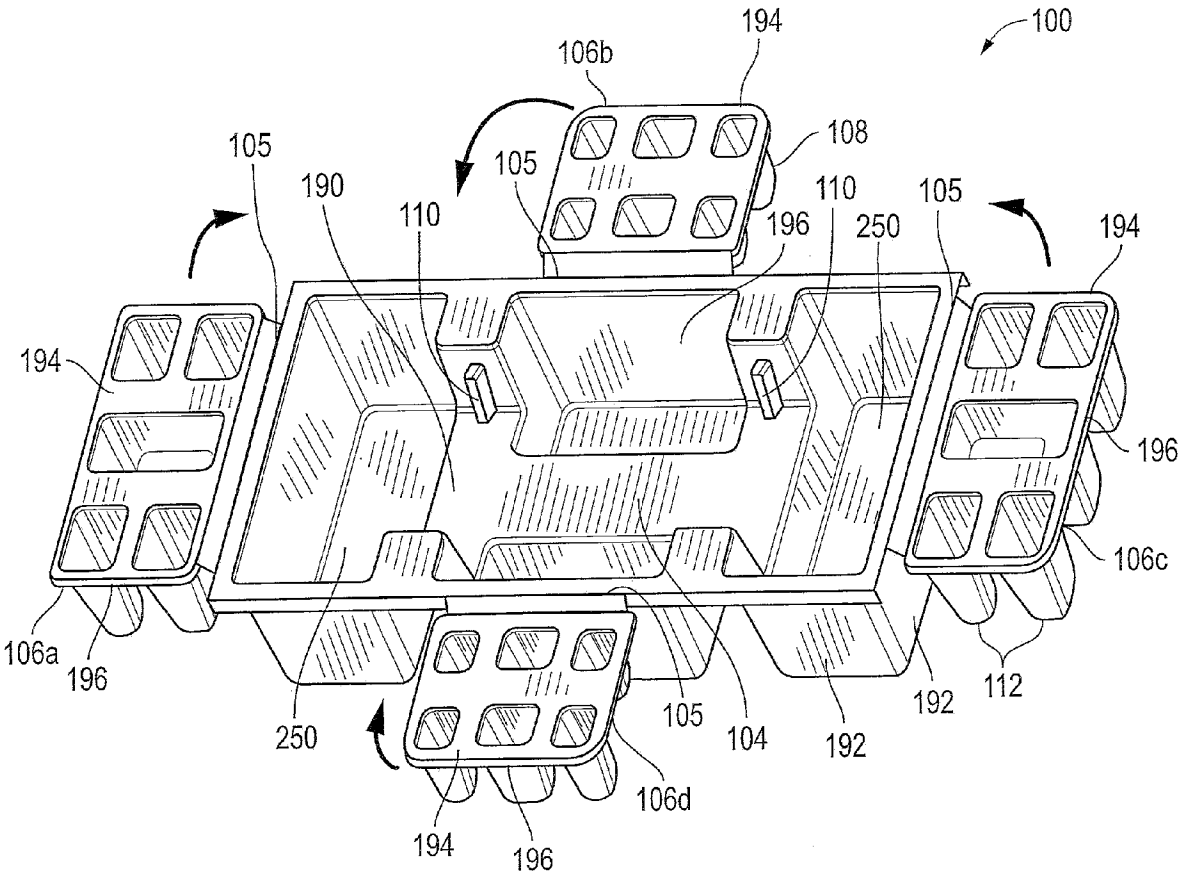
FIG. 10 is a perspective view of a packing device according to one embodiment of the disclosed apparatus and methods.
Figure 11:
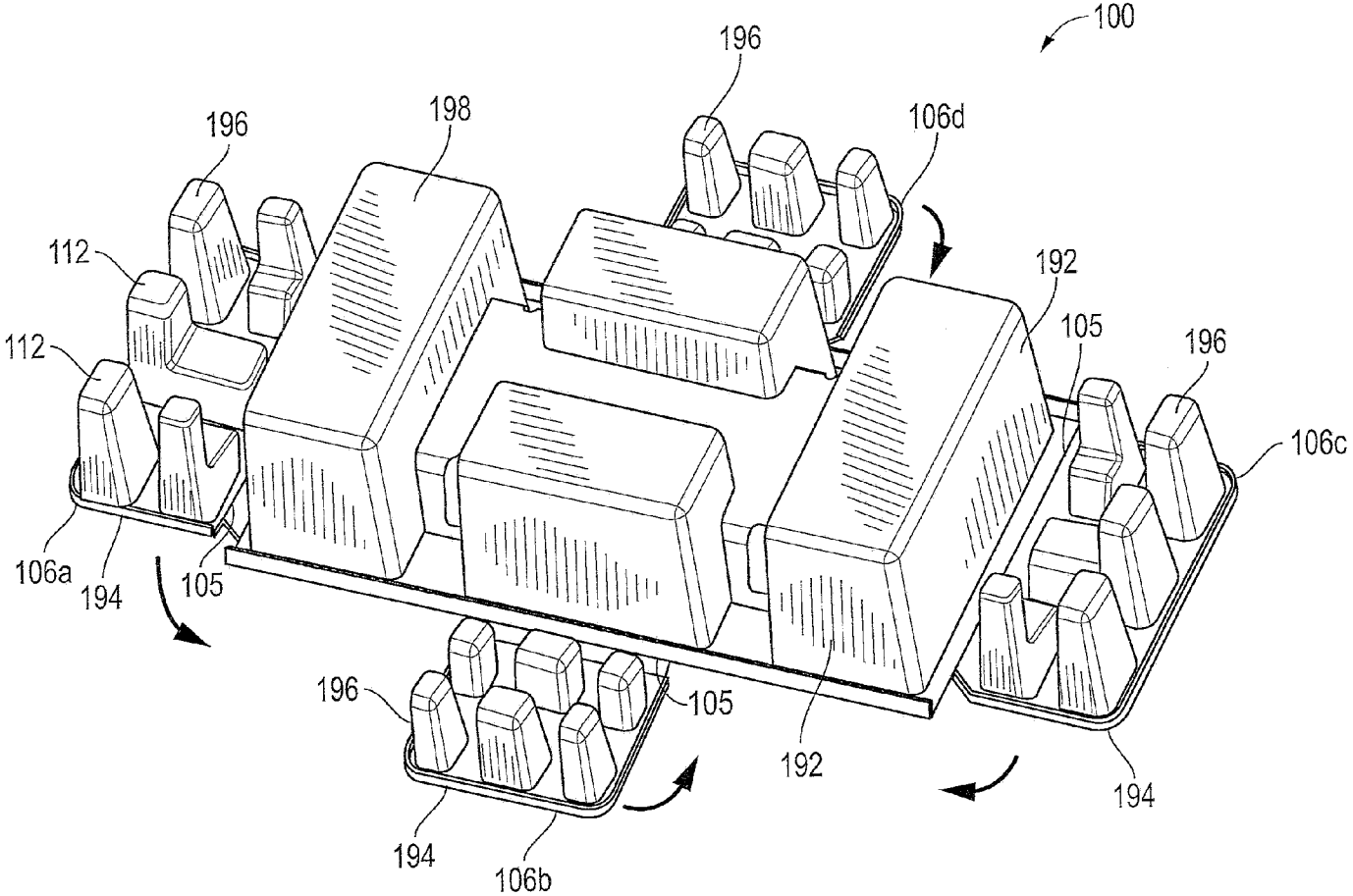
FIG. 11 is a perspective view of a packing device according to one embodiment of the disclosed apparatus and methods.
Figure 12:
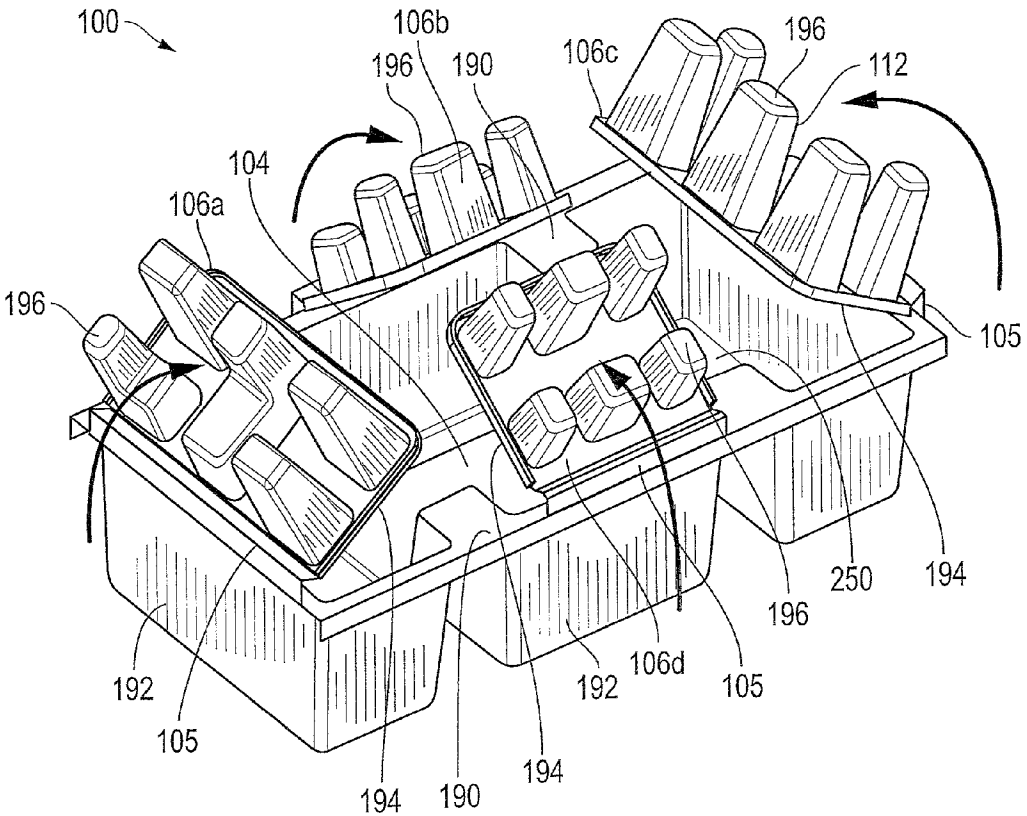
FIG. 12 is a perspective view of a packing device according to one embodiment of the disclosed apparatus and methods.
Figure 13:
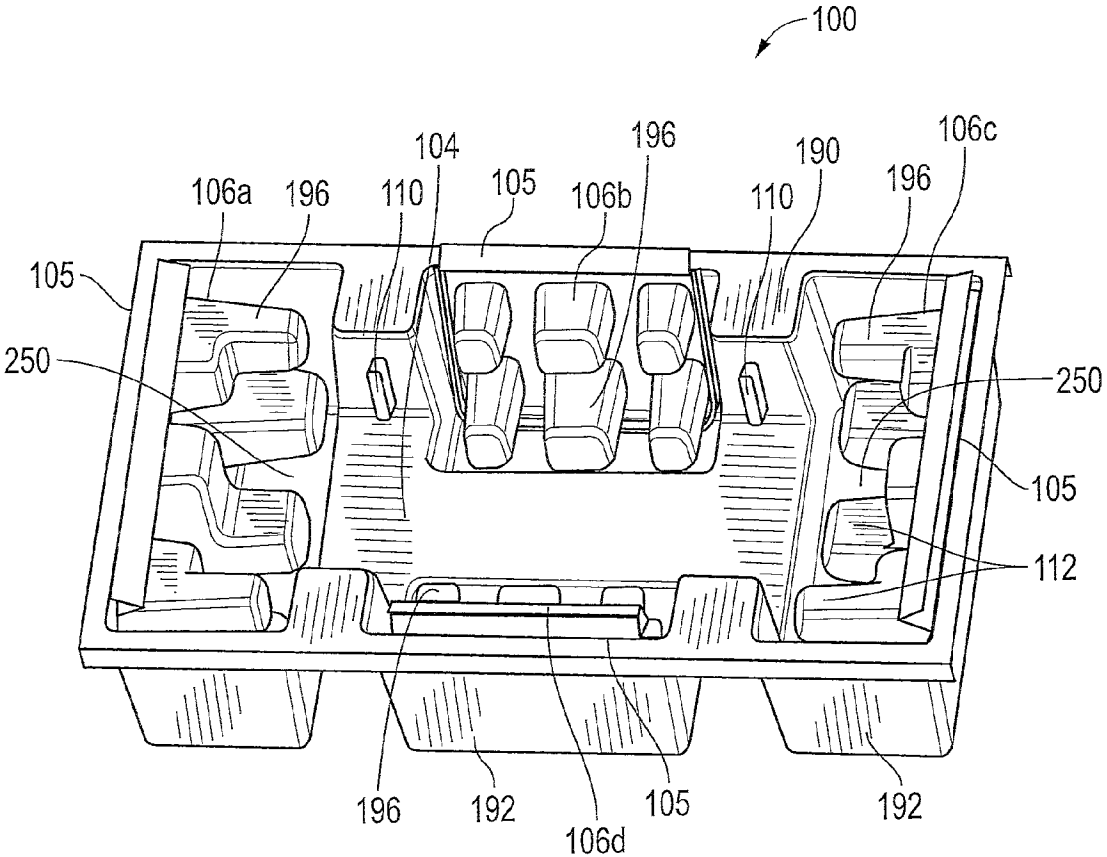
FIG. 13 is a perspective view of a packing device according to one embodiment of the disclosed apparatus and methods.

As may be seen in FIGS. 7 and 9 each buffer extension member 112 may be tapered to widen in a direction away from its distal end so as to cause a frictional fit when inserted between mating main section extension members 108 of a given buffer retention cavity 114 and in doing so retain each foldable buffer section 106 in its folded and engaged position within its corresponding buffer retention cavity 108. As also shown, each main section extension member 108 may be similarly tapered to widen in a direction away from its distal end to further enhance this fictional fit between buffer extension member 112 and buffer retention cavity 108.

Figure 8:
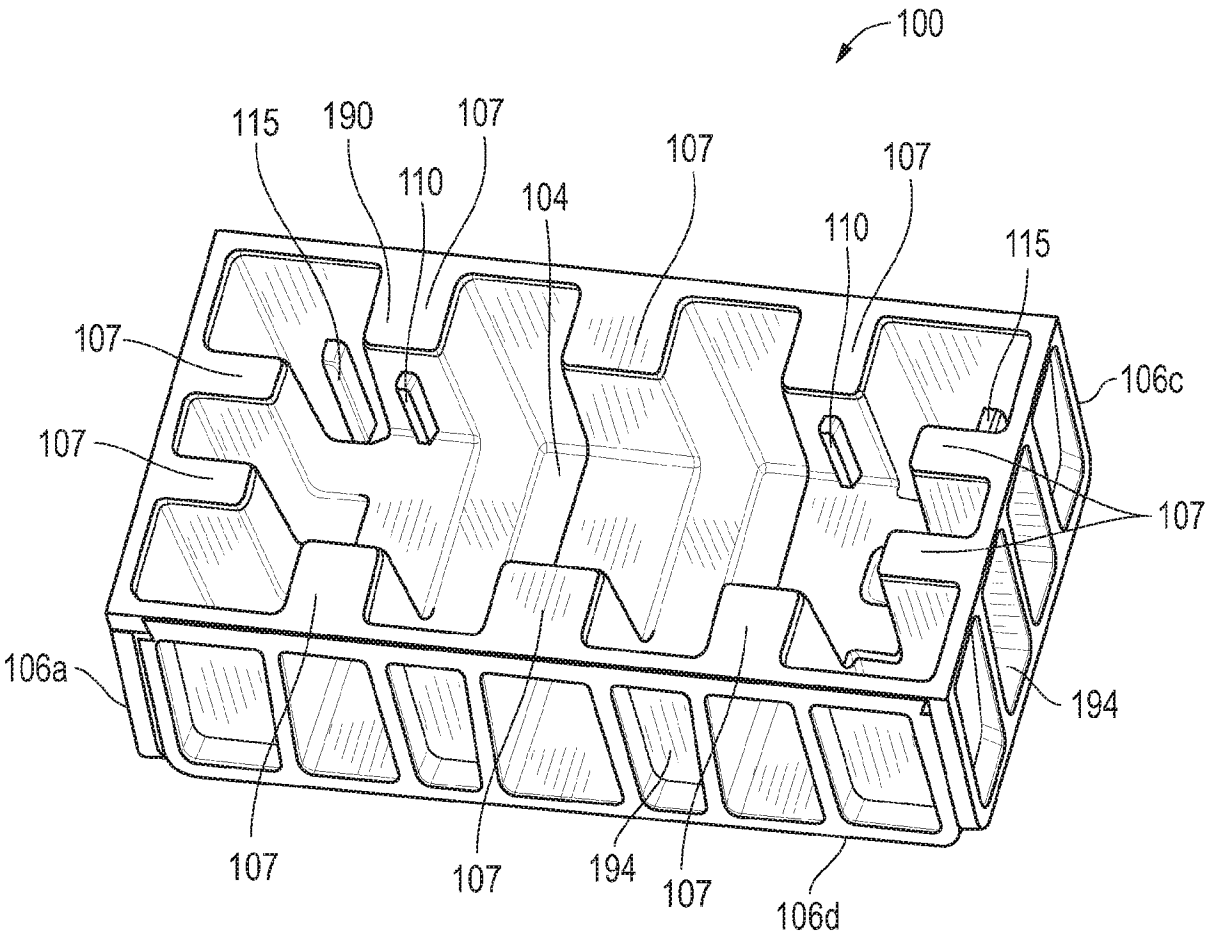
FIG. 8 is a perspective view of a packing device according to one embodiment of the disclosed apparatus and methods.

FIG. 8 illustrates a perspective view taken from the interior side of packing device 100 with its foldable buffer sections 106*a*, 106*b*, 106*c* and 106*d* disposed in folded engaged packing position with main section 102. FIG. 9 illustrates a corresponding perspective view taken from the exterior side of packing device 100 with its foldable buffer sections 106*a*, 106*b*, 106*c* and 106*d* disposed in folded engaged packing position with main section 102 such that the second side 196 of each buffer section 106 is disposed in face-to-face relationship with a peripheral side 192 of main section 102, and with buffer extension members 112 received into corresponding buffer retention cavities 114 defined between mating main section extension members 108 on the peripheral side 192 of the main section 102. It will be understood that the configuration and operation of main section extension members, buffer retention cavities 114, and buffer extension members 112 shown for the embodiment of FIGS. 7 and 9 are representative of buffer retention cavities 114 and buffer extension members 112 of the embodiment of FIGS. 1-5. Moreover, it will be understood that in other embodiments that the shape and number of main section extension members 108, buffer retention cavities 114 and buffer extension members 112 may vary.

It will also be understood that in other embodiments a packing device 100 may be alternatively configured without the presence of any mating buffer extension members 112 and/or buffer retention cavities 114, e.g., second side 196 of a foldable buffer section 106 and/or exterior surface 192 of main section 102 may be substantially flat or otherwise shaped such that no mating buffer extension member 112 is provided on second side 196 of foldable buffer section 106 and/or no corresponding buffer retention cavity 114 in main section 102 is provided. In such an alternative embodiment, other retention features may be employed to retain the folded buffer section/s 106 in folded engaged position with main section 102. Examples of other types of retention features that may be employed together or in the alternative to buffer retention cavities include, but are not limited to, plastic clips or other separate fasteners, integral retention structures such as corresponding integral male and female mating retention features formed integral to each of main section 102 and each buffer section 106, etc. In one embodiment inward pressure from contact between the folded buffer sections 106 and the interior surfaces of a shipping container 512 may be relied upon to retain folded buffer section/s 106 in folded engaged position when a packing device system with a corresponding object is placed within a suitably dimensioned shipping container. In other cases, hinge features of hinge lines 105 may be configured in any manner that resists movement of each foldable buffer section 106 from its folded packing position.

FIGS. 10-13 illustrate another exemplary embodiment of packing device 100 that includes foldable buffer sections 106*a*, 106*b*, 106*c* and 106*d* that are each hingeably attached at a respective hinge line 105 to a respective one of four opposing peripheral sides 192 of main section 102, but in this case configured for folding in the direction of the arrows toward the opening side 190 of main section 102. In this regard, the second side 196 of each of foldable buffer sections 106*a*, 106*b*, 106*c* and 106*d* is configured and dimensioned to be folded and received into corresponding buffer retention cavities 250 defined in the opening side 190 of the main section 102 when the buffer sections 106 are folded toward the opening side 190 of main section 102 in the direction of the arrows shown. Also shown in this embodiment are optional stacking ribs 115 that may be provided (in this case in on the opening side 190 of main section 102) for facilitating separation of individual packing devices 100 that have been "nested" (i.e., stacked one within another) by preventing one packing device 100 from nesting too deep within the object cavity 104 of an adjacent nested packing device 100.

In the embodiment of FIGS. 10-13, each of foldable buffer sections 106 is provided on its second side 196 with multiple buffer extension members 112, although the number of buffer extension members 114 may vary (e.g., may be one or more buffer extension members 112). Although multiple buffer extension members 112 are provided in this embodiment for each foldable buffer section 106, it will be understood that only one buffer extension member 112 may be provided for a given foldable buffer section 106. Further, as with other embodiments described herein, it will be understood that any suitable retention features, structure and/or methodology may be employed to retain the folded buffer section/s 106 in folded engaged position within main section 102 (e.g., such as plastic clips or other separate fasteners, integral retention structures, etc.), or hinge features of hinge lines 105 may be configured such that they resist movement of each foldable buffer section 106 from its folded packing position.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed apparatus and methods may be utilized in various combinations and/or independently. Thus the invention is not limited to only those combinations shown herein, but rather may include other combinations.

What is claimed is:

1. A device for packing an object, comprising:

a main section having a planar opening side with an opening defined therein, a body side disposed opposite from the opening side, and multiple peripheral sides extending between the opening side and the body side, an object cavity being defined in the main section between the peripheral sides that is continuous with the opening defined in the planar opening side of the main section, the object cavity being configured to receive a portion of the object through the opening for packing;

a hinge feature defining a hinge line at an intersection of one of the peripheral sides of the main section with the planar opening side such that the hinge line is co-planar with the planar opening side; and a buffer section coupled to the peripheral side of the main section by the hinge feature, the buffer section being configured to fold about the hinge line from an extended position to a folded packing position relative to the main section;

where the buffer section has opposing first and second sides, where the hinge feature is disposed adjacent and contiguous with the planar opening side of the main section and hingeably couples the buffer section to the main section such that the first side of the buffer section faces the same direction as the opening side of the main section when the buffer section is disposed in its extended position, and such that the second side of the buffer section is disposed in face-to-face relationship with an exterior surface of a peripheral side of the main section when the buffer section is positioned in its folded packing position.

2. The device of claim 1, where the foldable buffer section at least partially supports the packing device against external forces so as to strengthen the packing device against bending in response to the external forces.

3. The device of claim 1, where the main section includes two opposing peripheral sides with the object cavity defined therebetween; where the device further comprises a buffer section coupled to each of the two opposing peripheral sides of the main section by a respective hinge feature, each of the buffer sections being configured to fold about its respective hinge line from an extended position to a folded packing position relative to the main section; where each of the respective hinge features is disposed adjacent and contiguous with the planar opening side of the main section and hingeably couples one of the respective buffer sections to the main section such that the first side of each given buffer section faces the same direction as the opening side of the main section when the given buffer section is disposed in its extended position, and such that the second side of the given buffer section is disposed in face-to-face relationship with the peripheral side of the main section when the given buffer section is positioned in its folded packing position.

4. The device of claim 1, where the main section and buffer section are dimensioned to be received and contained within the interior of a shipping container with a portion of the object received within the object cavity of the main section, and with the buffer section positioned in its folded packing position.

5. The device of claim 1, where each of the main section, hinge feature and buffer section are formed from a single piece of material.

6. The device of claim 1, where each of the main section, hinge feature and buffer section are formed from a single piece of molded pulp fiber.

7. The device of claim 1, wherein the object for packing is an information handling system.

8. A device for packing an object, comprising:

a main section having an opening side, a body side and multiple peripheral sides, an object cavity being defined in the main section between the peripheral sides that is continuous with the opening side of the main section, the object cavity being configured to receive a portion of the object for packing;

a hinge feature defining a hinge line on one of the peripheral sides of the main section; and a buffer section coupled to the peripheral side of the main section by the hinge feature, the buffer section being configured to fold about the hinge line from an extended position to a folded packing position relative to the main section;

where the main section has at least two spaced main section extension members that extend between the opening side and the body side to define a buffer retention cavity between the main section extension members, the buffer retention cavity being defined in at least one of the peripheral sides of the main section;

where the buffer section has opposing first and second sides with at least one buffer extension member defined on the second one of the opposing sides;

where the buffer section has opposing first and second sides, where the hinge feature is disposed adjacent and contiguous with the planar opening side of the main section and hingeably couples the buffer section to the main section such that the first side of the buffer section faces the same direction as the opening side of the main section when the buffer section is disposed in its extended position, and such that the second side of the buffer section is disposed in face-to-face relationship with an exterior surface of a peripheral side of the main section when the buffer section is positioned in its folded packing position; and where the buffer retention cavity is dimensioned and configured to receive the at least one buffer extension member in a mated position between the at least two spaced main section extension members; and where the hinge feature hingeably couples the buffer section to the main section such that the buffer extension member of the second side of the buffer section is received within the buffer retention cavity of the main section when the buffer section is positioned in its folded packing position, and such that the buffer extension member of the second side of the buffer section is not received within the buffer retention cavity of the main section when the buffer section is positioned in its extended position.

9. The device of claim 8, where the buffer retention cavity of the main section is defined in a first peripheral side of the main section; such that the buffer extension member of the second side of the buffer section is received within the buffer retention cavity of the main section when the buffer section is positioned in its folded packing position.

10. The device of claim 8, where the buffer retention cavity of the main section has dimensions shaped complementary to, and the at least two main spaced main section extension members are configured to frictionally mate with, the shape of the buffer extension member of the buffer section when the buffer extension member is received within the buffer retention cavity of the main section in a manner that acts to frictionally retain the buffer section in the folded packing position between the at least two main spaced main section extension members relative to the main section.

11. A packing device system, comprising:

at least two packing devices, each of the two packing devices comprising:

a planar opening side with an opening defined therein, a body side disposed opposite from the opening side, and multiple peripheral sides extending between the opening side and the body side, an object cavity being defined in the main section between the peripheral sides that is continuous with the opening defined in the planar opening side of the main section, the object cavity being configured to receive a portion of the object through the opening for packing, a hinge feature defining a hinge line at an intersection of one of the peripheral sides of the main section with the planar opening side such that the hinge line is coplanar with the planar opening side, and a buffer section coupled to the peripheral side of the main section by the hinge feature, the buffer section being configured to fold about the hinge line from an extended position to a folded packing position relative to the main section, where the buffer section has opposing first and second sides, where the hinge feature is disposed adjacent and contiguous with the planar opening side of the main section and hingeably couples the buffer section to the main section such that the first side of the buffer section faces the same direction as the opening side of the main section when the buffer section is disposed in its extended position, and such that the second side of the buffer section is disposed in face-to-face relationship with an exterior surface of a peripheral side of the main section when the buffer section is positioned in its folded packing position; and where the object cavity of a first one of the two packing devices is configured to receive a first end of the object for packing, and where the object cavity of a second one of the two packing devices is configured to receive a second end of the object for packing, the first and second ends of the object being opposing ends of the object for packing.

12. The system of claim 11, where each respective one of the two packing devices is dimensioned to be received and contained within the interior of a shipping container with the buffer section of each of the packing devices being positioned in its folded packing position relative to the main section of the respective packing device, and with the opposing ends of the object being received within the object cavity of the main section portion of each of the respective two packing devices such that the object is freely suspended within the interior of the shipping container between the two respective packing devices.

13. The system of claim 11, further comprising a shipping container having an interior configured to receive the two packing devices together with an object for packing that is positioned between the two packing devices with a first end of the object for packing being received within the object cavity of the first packing device and with the second end of the object for packing being received within the object cavity of the second packing device, and with the buffer section of each of the respective packing devices being positioned in its folded packing position relative to the main section of the respective packing device.

14. The system of claim 11, further comprising an object for packing and a shipping container, the two packing devices being positioned within the interior of the shipping container together with the object for packing and with the object being positioned between the two packing devices such that a first end of the object for packing is received within the object cavity of the first packing device and such that the second end of the object for packing is received within the object cavity of the second packing device, and with the buffer section of each of the respective packing devices being positioned in its folded packing position relative to the main section of the respective packing device.

15. The system of claim 11, where each of the main section, hinge feature and buffer section of each packing device are formed from a single piece of molded pulp fiber.

16. The system of claim 11, wherein the object for packing is an information handling system.

17. A method for packing an object, comprising:

providing at least one packing device, comprising:

a main section having a planar opening side with an opening defined therein, a body side disposed opposite from the opening side, and multiple peripheral sides extending between the opening side and the body side, an object cavity being defined in the main section between the peripheral sides that is continuous with the opening defined in the planar opening side of the main section, the object cavity being configured to receive a portion of the object through the opening for packing, a hinge feature defining a hinge line at an intersection of one of the peripheral sides of the main section with the planar opening side such that the hinge line is coplanar with the planar opening side, and a buffer section coupled to the peripheral side of the main section by the hinge feature, the buffer section being configured to fold about the hinge line from an extended position to a folded packing position relative to the main section, where the buffer section has opposing first and second sides; where the hinge feature is disposed adjacent and contiguous with the planar opening side of the main section and hingeably couples the buffer section to the main section such that the first side of the buffer section faces the same direction as the opening side of the main section when the buffer section is disposed in its extended position, and such that the second side of the buffer section is disposed in face-to-face relationship with an exterior surface of a peripheral side of the main section when the buffer section is positioned in its folded packing position, or where the buffer section is configured to fold about the hinge line from the extended position through the opening defined in the planar opening side of the main section to a folded packing position with the buffer section received inside the main section such that the first side of the buffer section faces the same direction as the opening side of the main section when the buffer section is disposed in its extended position, and such that the first side of the buffer section is disposed in face-to-face relationship with an interior surface of a peripheral side of the main section when the buffer section is positioned in its folded packing position;

providing an object for packing;

positioning at least a portion of the object for packing within the object cavity of the packing device to form an assembly of the packing device with the object;

providing a shipping container having an interior configured to receive the assembly of the object and the packing device;

folding the buffer section about the hinge line from the extended position to the folded packing position relative to the main section; and then positioning the assembly of the object and the packing device within the interior of the shipping container.

18. The method of claim 17, further comprising:

providing at least two packing devices, each of the two packing devices comprising:

a main section having a planar opening side with an opening defined therein, a body side disposed opposite from the opening side, and multiple peripheral sides extending between the opening side and the body side, an object cavity being defined in the main section between the peripheral sides that is continuous with the opening defined in the planar opening side of the main section, the object cavity being configured to receive a portion of the object through the opening for packing, a hinge feature defining a hinge line at an intersection of one of the peripheral sides of the main section with the planar opening side such that the hinge line is co-planar with the planar opening side, and a buffer section coupled to the peripheral side of the main section by the hinge feature, the buffer section being configured to fold about the hinge line from an extended position to a folded packing position relative to the main section, where the buffer section has opposing first and second sides, where the hinge feature is disposed adjacent and contiguous with the planar opening side of the main section and hingeably couples the buffer section to the main section such that the first side of the buffer section faces the same direction as the opening side of the main section when the buffer section is disposed in its extended position, and such that the second side of the buffer section is disposed in face-to-face relationship with an exterior surface of a peripheral side of the main section when the buffer section is positioned in its folded packing position, or where the buffer section is configured to fold about the hinge line from the extended position through the opening defined in the planar opening side of the main section to a folded packing position with the buffer section received inside the main section such that the first side of the buffer section faces the same direction as the opening side of the main section when the buffer section is disposed in its extended position, and such that the first side of the buffer section is disposed in face-to-face relationship with an interior surface of a peripheral side of the main section when the buffer section is positioned in its folded packing position;

providing an object for packing that has first and second opposing ends;

positioning the first end of the object for packing within the object cavity of a first one of the two packing devices and positioning the second end of the object for packing within the object cavity of a second one of the two packing devices to form an assembly of the first and second packing devices with the object therebetween;

providing a shipping container having an interior configured to receive the assembly of the object and first and second packing devices;

folding the buffer section of each of the two packing devices about the hinge line from the extended position to a folded packing position relative to the main section of each of the two packing devices; and then positioning the assembly of the object and first and second packing devices within the interior of the shipping container such that the object is freely suspended within the interior of the shipping container between the two packing devices.

19. The method of claim 17, where each of the main section, hinge feature and buffer section of each packing device are formed from a single piece of molded pulp fiber.

20. The method of claim 17, wherein the object for packing is an information handling system.

21. A device for packing an object, comprising:

a main section having a planar opening side with an opening defined therein, a body side disposed opposite from the opening side, and multiple peripheral sides extending between the opening side and the body side, an object cavity being defined in the main section between the peripheral sides that is continuous with the opening defined in the planar opening side of the main section, the object cavity being configured to receive a portion of the object through the opening for packing;

a hinge feature defining a hinge line at an intersection of one of the peripheral sides of the main section with the planar opening side such that the hinge line is co-planar with the planar opening side; and a buffer section coupled to the peripheral side of the main section by the hinge feature, the buffer section being configured to fold about the hinge line from an extended position to a folded packing position relative to the main section;

where the buffer section has opposing first and second sides, where the buffer section is configured to fold about the hinge line from the extended position through the opening defined in the planar opening side of the main section to a folded packing position with the buffer section received inside the main section such that the first side of the buffer section faces the same direction as the opening side of the main section when the buffer section is disposed in its extended position, and such that the first side of the buffer section is disposed in face-to-face relationship with an interior surface of a peripheral side of the main section when the buffer section is positioned in its folded packing position.

22. The device of claim 21, where the main section has at least one buffer retention cavity defined in the opening side of the main section, the buffer retention cavity being dimensioned and configured to receive at least a portion of the buffer section; and where the hinge feature hingeably couples the buffer section to the main section such that at least a portion of the buffer section is disposed within the buffer retention cavity when the buffer section is positioned in its folded packing position, and such that no portion of the buffer extension member is received within the buffer retention cavity of the main section when the buffer section is positioned in its extended position.

23. The device of claim 21, further comprising a buffer retention cavity defined in the main section between the peripheral sides that is continuous with the opening defined in the planar opening side of the main section; where the hinge feature is disposed adjacent and contiguous with the planar opening side of the main section and hingeably couples the buffer section to the main section such that at least a portion of the first side of the buffer section is received within the buffer retention cavity when the buffer section is positioned in its folded packing position.

* * * * *